United States Patent [19]

Cizaire

[11] Patent Number: 4,887,726

[45] Date of Patent: Dec. 19, 1989

[54] BOTTLE STAND

[76] Inventor: Ivan Cizaire, Chemin du Mourion Haut, 30400 Villeneuve les Avignon, France

[21] Appl. No.: 304,605

[22] Filed: Feb. 1, 1989

[30] Foreign Application Priority Data

Feb. 5, 1988 [FR] France ..... 88 01387

[51] Int. Cl.[4] ..... A47B 73/00

[52] U.S. Cl. ..... 211/74

[58] Field of Search ..... 211/74, 75; 248/312, 248/312.1, 312.2; D7/71

[56] References Cited

U.S. PATENT DOCUMENTS 3,901,389 8/1975 Belokin, Jr. .
4,496,124 1/1985 Cole ..... 211/74 X
4,515,334 5/1985 Horne .

FOREIGN PATENT DOCUMENTS 1946314 3/1971 Fed. Rep. of Germany .
2141618 1/1985 United Kingdom .

*Primary Examiner*—Robert W. Gibson, Jr.
*Attorney, Agent, or Firm*—Mason, Fenwick & Lawrence

[57] ABSTRACT

The stand comprises a number of holding devices (4) which are disposed on a rigid elongated section member (1) and each form a front upper support (22) and a rear lower support (18). These supports have a generally curved shape but are facing in opposite directions and offset not only in height but laterally, and are spaced apart from each other in the horizontal direction a distance at the most equal to the length of the neck of a bottle, so that the bottle is carried solely by its neck in an inclined position with the neck extending upwardly.

12 Claims, 7 Drawing Sheets

BOTTLE STAND

Bottles are usually stored in a horizontal position in racks which form at least two supports on which the body of the bottle rests. The neck is in this wa completely free and it is ensured that the liquid contained in the bottle is in permanent contact with the stopper of the latter.

On the other hand, the bottle must be withdrawn for reading its label and this must most often be done by holding the bottle by the neck. Moreover, the racks have a relatively large overall size, since this size must correspond to the entire length of the bottle and these racks occupy the same space whether they are full or empty.

An object of the present invention is to overcome these drawbacks by providing a bottle stand which has a very small overall size and yet permits an effective holding of a large number of bottles and an easy reading of their labels.

The invention indeed provides a bottle stand comprising at least one rigid elongated section member, and at least one holding device for the neck of a bottle mounted on said section member or section members, formed by a rear support and a front support which face in opposite directions and are offset in height and spaced apart a distance which is less than the length of a normal glass bottle neck, wherein at least one of the rear and front supports is formed by a curved member which is carried by a fixing element for fixing to the section member and is laterally and downwardly inclined relative to the plane of the section member so that the neck of the bottle extends upwardly According to another feature of the invention, the front and rear supports of successive holding devices are alternately laterally offset to the left and the right.

With this arrangement, the bottles are held solely by their neck and the holding devices have a length which is less than the length of the normal neck of a bottle. The stand therefore has an extremely small overall size while the inclination of the bottles ensures both a firm fixing of the bottles and an easy reading of the labels.

According to a modification, the bottle stand comprises a plurality of section members assembled in pairs and each provided with holding devices.

Each section member provided with holding devices may be assembled by cross-members to other similiar section members and thereby constitute a complete storage unit.

The stand is therefore suitable for various utilizations and may be adapted to the shape and dimension of the storage premises.

The following description of embodiments of the invention given by way of examples and shown in the accompanying drawings will show the advantages and features of the invention.

Figure 1:
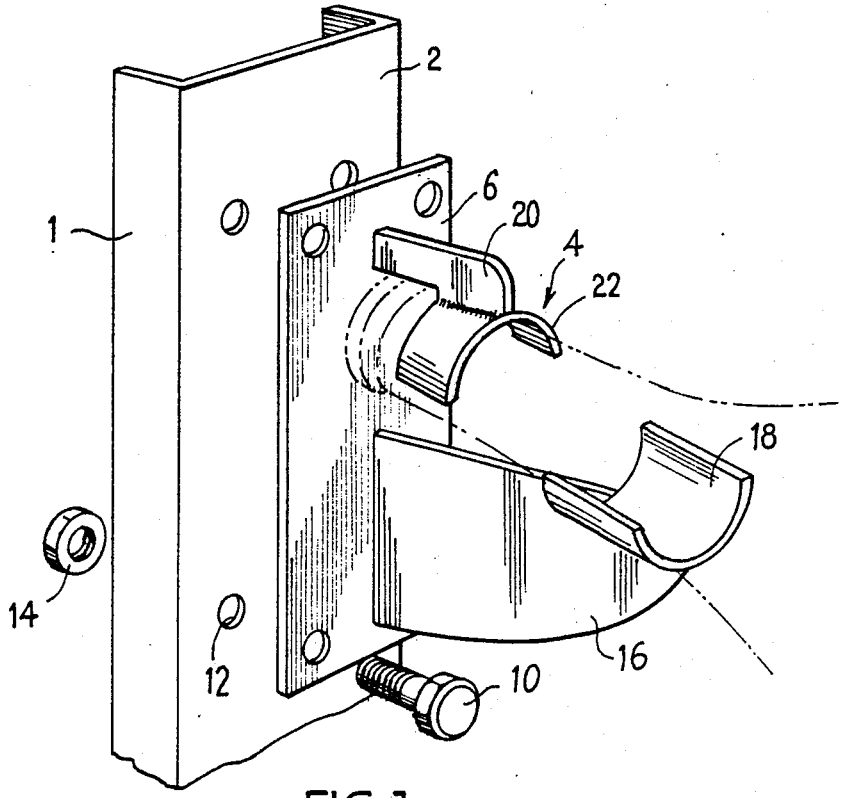
FIG. 1 is an exploded perspective view of a bottle stand according to the invention.

The bottle stand according to the invention comprises at least one rigid elongated section member 1 which has at least one longitudinal planar surface 2 but may have any desired section, for example a square, rectangular or preferably a U-section as shown. This section member which may be disposed vertically or horizontally is adapted to carry on its longitudinal planar surface 2 at least one holding device for the neck of a bottle 4.

The holding device 4 comprises indeed a fixing plate 6 provided in each of its corners with an aperture 8 for the passage of a screw 10 or the like which also extends through an aperture 12 in the section member 1 and is firmly held in position by a nut 14 screwed on the screw. Extending from the plate 6 is a flat and vertical wing 16 which is substantially perpendicular to the plate 6 and carries on the end thereof remote from the plate a support 18 in the form of a semi-cylindrical cup whose concavity faces upwardly and whose inside diameter substantially corresponds to the outside diameter of a bottleneck. The cup 18 is fixed to a beveled end of the wing 16 so that it is inclined to the horizontal in the downward direction away from the plate 6.

The plate 6 also carries above the wing 16 an arm 20 parallel to the wing 16 but much shorter than the latter. Suspended from this arm 20 is an upper support 22, formed in the same way as the support 18 by a semi-cylindrical cup but having its concavity facing downwardly. The support 22 is, in the same way as the element 18, downwardly inclined to the horizontal in the direction away from the plate 6. Further, the axes of the two cups 18 and 22, which are parallel to each other, are laterally inclined relative to the wing 16 and to the arm 20, i.e., to the vertical plane perpendicular to the plate 6.

The angle of inclination of the cups 18 and 22 is small, for example on the order of 10°, while the length of the wing 16 is less than that of the neck of a normal bottle. Thus any glass bottle, whether it be a 35 cl, 75 cl, or 1 L bottle, may be placed in the holding device as indicated in dot-dash lines in FIG. 1, so that its neck bears in its lower part on the cup 18 and in its upper part under the cup 22. It will be observed that the combination of these two supports with the weight of the bottle ensures that the latter is firmly held whether it is full or empty.

Furthermore, the inclination of the bottle is such that the liquid therein permanently remains in contact with the stopper.

It will be clear that the holding device 4 has an extremely small overall size and that the bottle can be in any case easily placed in position or withdrawn, the bottle being handled by its heaviest part, i.e., its body.

The section member 1, of course preferably supports a certain number of holding devices 4 evenly spaced apart along its length. In this case, the cups 22 and 18 of the successive devices are alternately offset to the right and to the left so that the bottles placed in these devices extend away from each other in the direction away from the section member, which affords free access to the bottles and consequently enables their labels to be easily read without moving the bottles.

Of course, instead of employing cups 18 and 22 which are laterally offset relative to the wing 16 and the arm 20 respectively, the holding device could have a wing 16 and an arm 20 which make a suitable angle with the plate 6 and be thus contained in the plane of symmetry of the cup it carries.

It is also possible to place between the section member 1 and the plate 6 a wedge-shaped shim which provides the desired lateral inclination. Such a shim may moreover have, in the same way as the shim 24 shown in FIGS. 2 and 3, a substantially triangular section and ensure itself both the lateral offset and the inlination to the horizontal.

Figure 2:
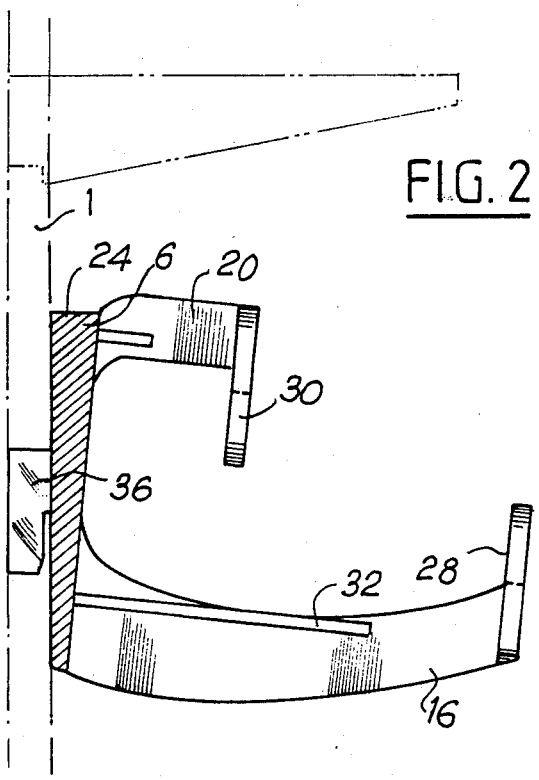
FIG. 2 is a side elevational view of a bottle stand according to one embodiment.
Figure 4:
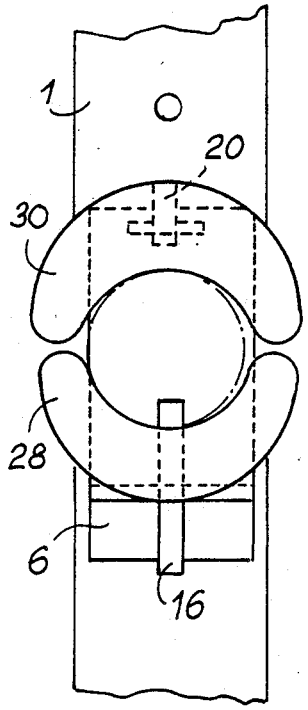
FIG. 4 is an end elevational view of the device of FIG. 2.
Figure 3:
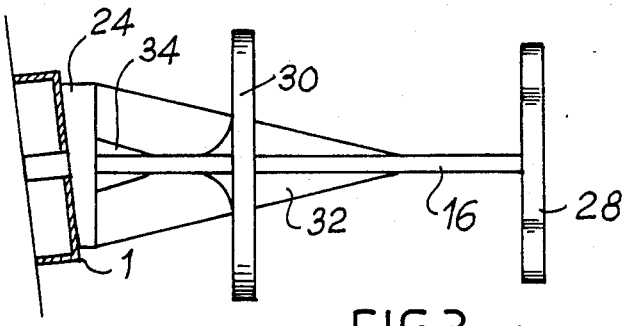
FIG. 3 is a top plan view of the device of FIG. 2.

FIGS. 2 to 4 illustrate an embodiment of the holding device which includes such a shim 24 and in which the fixing plate 6 carries two arms respectively 16 and 20 which are perpendicular thereto and consequently receive a lateral and downward inclination which is a function of the shape of the shim 24. The lower arm 16 carries at its end a flat member 28 in the shape of a crescent whose concavity faces upwardly and whose inside diameter is substantially equal to the outside diameter of the neck of a bottle. In the same way, the upper shorter arm 20 carries at its end a flat member 30 in the shape of a crescent whose concavity faces downwardly. The member 30 has dimensions similiar to those of the member 28 and is also perpendicular to the arm carrying it, i.e., parallel to the fixing plate 6.

Preferably, each of the arms is reinforced by horizontal ribs 32, 34, connecting it to the plate 6.

Figure 5:
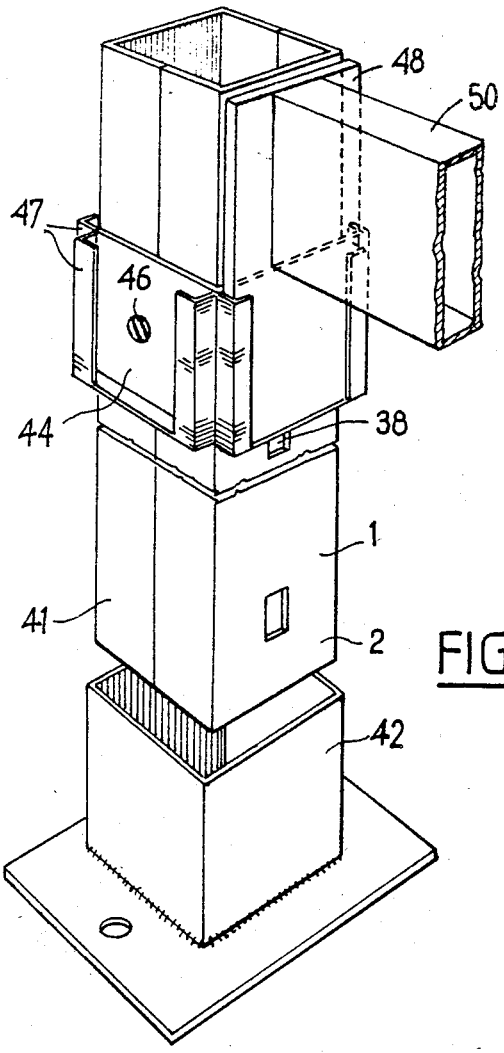
FIG. 5 is a perspective view of a post which is part of a bottle stand according to the invention.

The holding device designed in this way may be mounted on the section member 1 by screws as described with reference to FIG. 1 or as shown in FIGS. 2 to 4 by means of hooks 36 connected to the shim 24 an the fixing plate 6 and cooperating with slots 38 provided in the planar longitudinal side 2 of the section member 1 (FIG. 5).

The shim 24 may of course be connected to the plate 6 or even be in one piece with the latter and be, as shown, formed by a thickening of the fixing plate 6. In this case, the hook 36 is fixed to these two parts. The shim 24 may also be detachable and include an opening or even a slot in which a hook 36 fixed to the plate 6 is fitted. It is then possible with a single type of holding device and two types of shim, or reversible shims, to provide for the front and rear supports the desired inclinations and offset.

Depending on the size of the stand required, the section member 1 may have any desired length and may be used alone, with a certain number of holding devices, or be associated with another similar section member 41 so as to form a vertical post as shown in FIG. 5. In this case, the flanges 42 of two U-section members are placed in butting relation so that the planar sides 2 receiving the holding devices form two opposed sides of the post. The section members 1 and 41 are fitted together inside a retaining base 42 which constitutes a foot which rests on the ground and may even be fixed to the latter if desired.

In their upper part, and possibly in one or more intermediate parts, the two section members 1 and 41 are surrounded by a collar 44 of rectanglar or square section whose sides are in close contact with those of the post and which is fixed to the section members 1 and 41 by any suitable means such as screws 1 and 46. Preferably, each of the sides of the collar 44 includes on its two opposed vertical edges an L-shaped flange which forms a slideway 47 for receiving an end member 48 of a cross-member 50 for connection to another similiar post. A plurality of posts may be in this way assembled by cross-members 50 and constitute bottle stands of extremely variable dimensions corresponding to the available space for the storage.

The stand comprising a U-section member shown in FIG. 1 may however be employed alone or with other similiar stands placed next to it. Each section member 1, 61 is, in this case, fixed to a member or the like by any suitable means but preferably by at least one solid or hollow parallelsided packing block capable of being fitted in the U-section member. The block 52 then includes a throughway aperture 54 which is aligned with an aperture 56 in the section member when fitting these parts together and thereby permits the passage of a screw 58 which secures the assembly to the wall (FIG. 6).

The upper part of the section member 61 may furthermore be closed by a block 60 which is longer than the others and provided in its lower part with a groove 62 for fitting on the edge of the planar side 2 of the section member 61. If desired, a bracket 64 for supporting a shelf may be fixed to the closing block 60 when a plurality of identical bottle stands are arranged in side by side relation. A rack or shelf (not shown) may then be supported by the brackets 64 of a plurality of adjacent stands.

Figure 6:
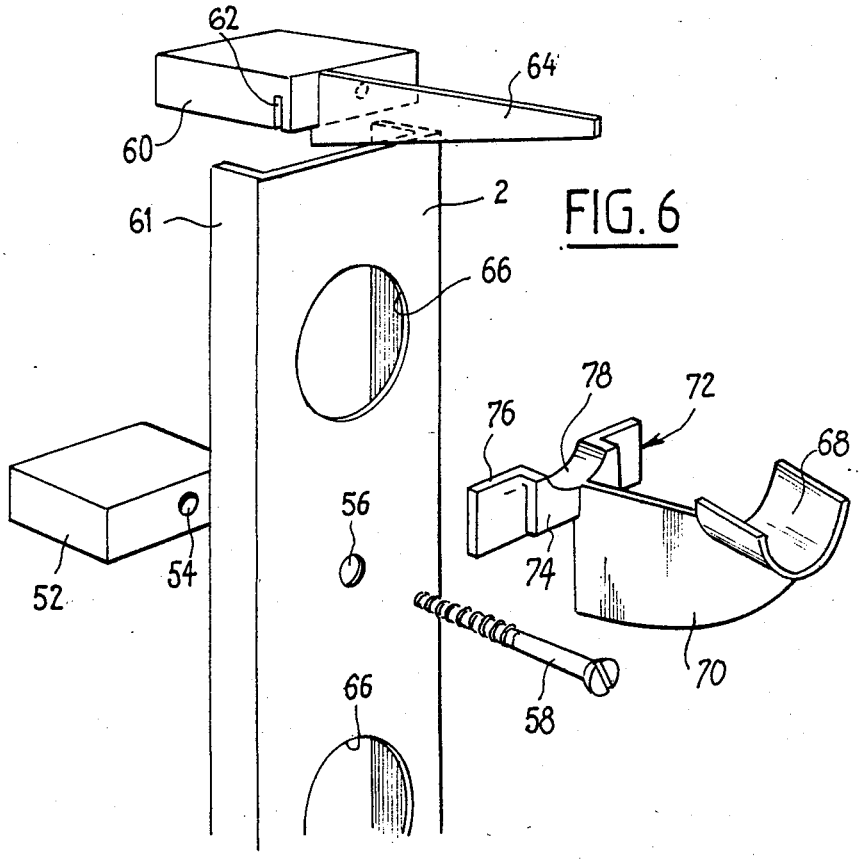
FIG. 6 is an exploded perspective view of a bottle stand according to another embodiment of the invention.
Figure 8:
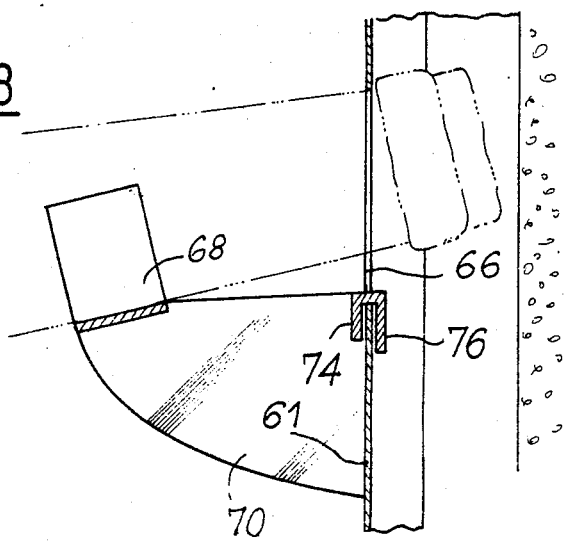
FIG. 8 is a sectional view taken on line 8—8 of FIG. 7.
Figure 7:
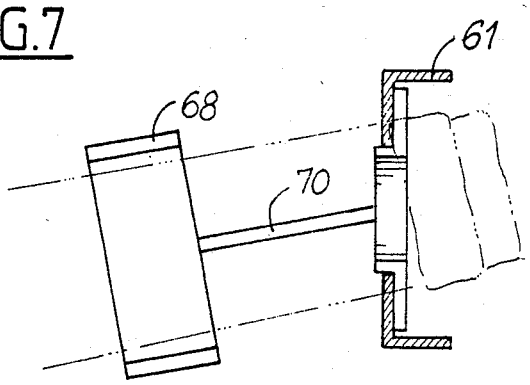
FIG. 7 is a top plan view of the holding device shown in FIG. 6 assembled on a section member of the stand.
Figure 10:
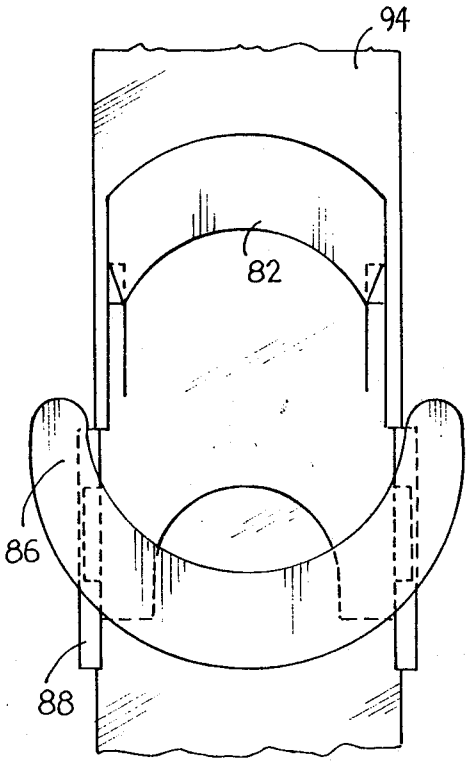
FIG. 10 is an end elevational view of the holding device of FIG. 9 assembled with a section member.
Figure 9:
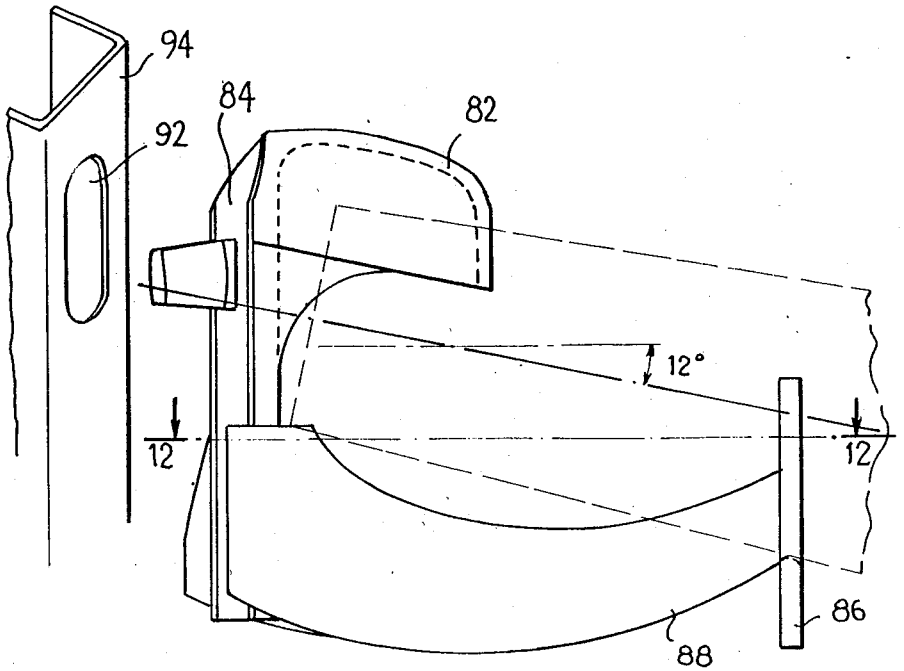
FIG. 9 is an exploded perspective view of another embodiment of the bottle stand.

The blocks 52 and 60 may have a depth similiar to that of the U-section member or, as shown in FIG. 6, may have a distinctly greater depth so as to define a space between the section member 61 and the wall to which it is secured. In this embodiment, the section member 61 is provided with orifices 66 evenly spaced apart and having a circular section, the upper edge of which constitutes the front support of the holding device. The rear support is formed by a cup 68 similiar to the cup 18 and carried in the same way as the latter by a flat and vertical wing 70 connected to a fixing member 72. The member 72 has the shape of a yoke whose two branches 74 and 76 have different widths while its base 78 is curved in the centre so as to be capable of matching the shape of the lower edge of the orifice 66. The wing 70 is connected to the small branch 74 of the yoke 72 but is laterally inclined to the perpendicular to the plane of this branch 74 at an angle of about 10°, as shown more particularly in FIG. 7. The two branches 74 and 76 of the yoke 72 are strictly parallel and planar and each come to bear against one of the sides of the wall of the section member 61 when the yoke straddles the edge of the orifice 66 (FIG. 8). In this way, they ensure a firm assembly for the cup 68 and its exact positioning when in use.

The neck of the bottle which must be supported is in this case inserted in the section member 61 so as to be in contact, on one hand, with the front upper support formed by the edge of the orifice 66 and, on the other hand, with the rear lower support constituted by the cup 68. As the orifice 66 has a diameter larger than that of a neck, the bottle is slighty downwardly inclined at an angle of about 10°, as in the foregoing embodiments.

The section member 61 comprises a plurality of orifices 66 spaced apart alon its length, these orifices each receiving a yoke 72 carrying a wing 70 laterally offset, but the wings of successive devices are alternately offset to the right and to the left.

It will be understood that the orifice 66 of circular section may be replaced by an orifice of some other shape, for example a diamond-shaped orifice, the shape of the yoke 72 being modified in consequence.

According to another embodiment of the invention shown in FIGS. 9 to 12, a holding device comprises a front or upper support 82 formed by a portion of a cylinder which is directly connected to the fixing plate 84 but has its axis and generatrices downwardly and laterally inclined relative to this plate. The rear lower support is formed by a flat member 86 in the shape of a crescent which is connected to the plate 84 by a slightly curved wide arm 88 which occupies almost the whole of the width of the flat crescent-shaped member 86. However, and as shown, the arm 88 is preferably hollow in its central part so as to lighten the device without imparing its strength.

Figure 11:
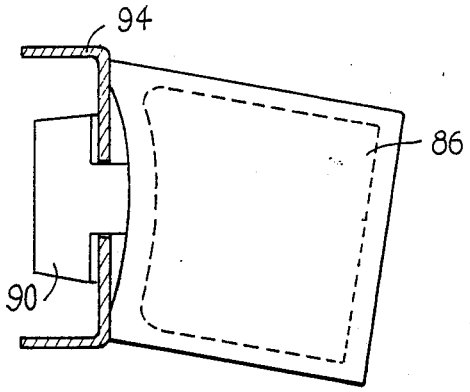
FIG. 11 is a top plan view of the bottle stand of FIG. 10.
Figure 12:
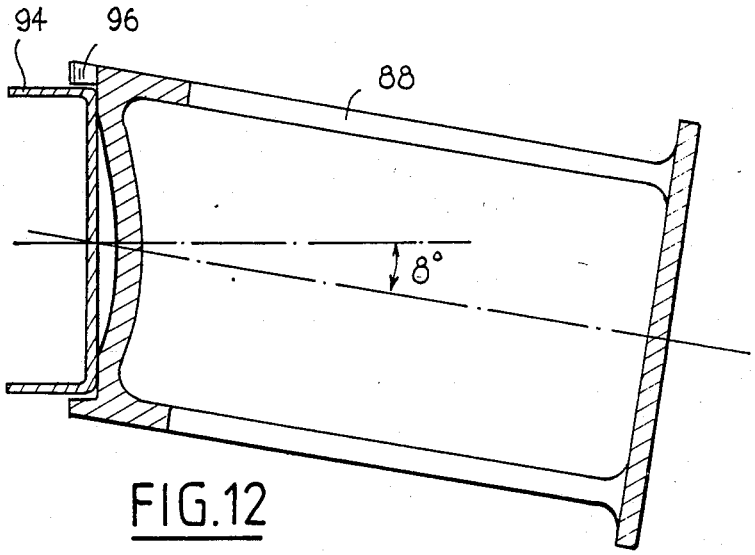
FIG. 12 is a sectional view taken on line 12—12 of FIG. 9.

The front and rear supports 82 and 86 are preferably in one piece wih the fixing plate 84 which has a concave rear surface from which extends a hooking member 90 for hooking in a slot 92 in a section member 94. The slot 92 has an oblong shape having a longitudinal large axis whereas the hooking member 90 has a T-shape whose bar extends transversely relative to the fixing plate. This member must therefore be pivoted and deformed in order to enter the slot, but elastically resumes its shape when it has been inserted and turned through 90°. It therefore retains the fixing plate against the section member by applying thereagainst the two edges of its concave side (FIGS. 11 and 12).

Preferably, the immobilization of the holding device is strengthened by extensions or lugs 95, 96 of the arm 88 which come to fit on each side of the section member 94 and prevent its pivoting under the action of the load constituted by the bottle.

In all cases, the bottle is extremely easy to place in position and withdraw, empty or full. It is firmly held in position while remaining accessible so that the labels can always be read. Moreover, in the absence of bottles, the stand has only a small overall size and the storage space for the bottles may be used for other purposes.

I claim:

1. Bottle stand comprising at least one rigid elongated section member having a longitudinal plane and at least one holding device for holding a neck of a bottle and mounted on said at least one section member, said holding device comprising a rear support and a front support facing in opposite directions, offset in height and spaced apart a distance less than the length of a normal glass bottle neck, at least one of said supports being constituted by a curved member, and a fixing element for fixing to the section member, said at least one support being connected to said fixing element and being laterally and downwardly inclined relative to said plane of the section member so that the neck of the bottle extends upwardly.

2. Bottle stand according to claim 1, comprising, on said at least one section member, a succession of holding devices aligned on a common side of said at least one section member but inclined alternately to the right and to the left.

3. Bottle stand according to claim 1, wherein said fixing element comprises a plate which is provided with hooking means for detachably hooking in orifices provided in the respective section member and is connected to at least one of said supports.

4. Bottle stand according to claim 1, wherein at least one of said supports is constituted by a cup in the shape of a portion of a cylinder having an axis which is downwardly and laterally inclined relative to said plane of said at least one section member.

5. Bottle stand according to claim 4, comprising an arm connecting said cup to said fixing element.

6. Bottle stand according to claim 1, wherein at least one of said supports is constituted by a crescent-shaped flat member and an arm which is part of said fixing element has an end which carries said flat member.

7. Bottle stand according to claim 1, wherein at least one of said supports is a curved support and a narrow arm which is part of said fixing element is fixed to a median part of said curved support.

8. Bottle stand according to claim 1, wherein at least one of said supports is a curved support and a wide and hollow arm which is part of said fixing element is connected to opposite ends of said curved support.

9. Bottle stand according to claim 1, wherein the fixing elemnt comprises a shim having a thickness which varies along the height and width of the shim and defines a reversible inclined surface which is selectively inclined to the left or right so as to impart to the holding device an inclined direction relative to said plane of the respective section member of the stand.

10. Bottle stand according to claim 3, wherein the holding device comprises, in the vicinity of said upper support, a hooking member for hooking in an opening in the respective section member and, in a lower part of the holding device, lateral lugs for fitting on each side of the respective section member.

11. Bottle stand according to claim 1, wherein said upper support is constituted by an upper edge of an orifice provided in the respective elongated section member.

12. Bottle stand according to claim 1, wherein said lower support is formed by a lower part of an edge of an orifice provided in the respective elongated section member.

* * * * *